US005984557A

United States Patent [19]

Fennell

[11] Patent Number: 5,984,557

[45] Date of Patent: Nov. 16, 1999

[54] GLUE GUIDE

[76] Inventor: Forrest S Fennell, 400 W. Grand River, P.O. Box 477, Webberville, Mich. 48892

[21] Appl. No.: 09/064,565

[22] Filed: Apr. 22, 1998

[51] Int. Cl.[6] ..... B05C 17/005

[52] U.S. Cl. ..... 401/193; 401/266

[58] Field of Search ..... 401/193, 10, 266

[56] References Cited

U.S. PATENT DOCUMENTS

| | | | |
|---|---|---|---|
| D. 353,397 | 12/1994 | Banik | D19/66 |
| 2,065,298 | 12/1936 | Abbott | 401/193 X |
| 2,402,310 | 6/1946 | Beaumier | 401/193 |
| 2,816,308 | 12/1957 | Schultz | 401/193 |
| 4,461,408 | 7/1984 | Shepard | 222/501 |
| 4,685,820 | 8/1987 | Kremer | 401/260 |
| 5,000,112 | 3/1991 | Rothen | 118/411 |
| 5,000,361 | 3/1991 | Briddell et al. | 401/193 X |
| 5,052,839 | 10/1991 | Pettengill | 401/10 X |
| 5,129,356 | 7/1992 | Bandy | 118/315 |
| 5,358,349 | 10/1994 | Burroughs | 401/184 |

FOREIGN PATENT DOCUMENTS

| | | | |
|---|---|---|---|
| 607657 | 9/1948 | United Kingdom | 401/193 |

*Primary Examiner*—Steven A. Bratlie
*Attorney, Agent, or Firm*—Goldstein & Canino

[57] ABSTRACT

A glue guide, for creating a bead of glue upon a workpiece having a pair of substantially parallel longitudinal edges and a work surface between the longitudinal edges and perpendicular thereto. The glue guide comprises a cross member, and a pair of straight edges extending perpendicular to the cross member. A holster is situated on the cross member, centered between the straight edges. The holster is tubular, shaped to accept a glue dispensing nozzle from a glue container. Once the glue dispensing nozzle is inserted into the holster, the straight edges engage the longitudinal edges of the workpiece, and guide the glue dispensing nozzle along the work surface, substantially parallel to the longitudinal edges. Thus, the glue dispensing nozzle can create a straight, uniform bead of glue that extends along the work surface and is centered between the longitudinal edges.

3 Claims, 3 Drawing Sheets

GLUE GUIDE

BACKGROUND OF THE INVENTION

The invention relates to a glue guide. More particularly, the invention relates to a device which accepts a glue dispensing nozzle, and which has at least one straight edge which contacts a longitudinal edge of a workpiece so that the glue dispensing nozzle is guided along the workpiece, while maintaining the glue dispensing nozzle parallel to the longitudinal edge.

Many construction tasks require application of a continuous bead of glue along a work surface. The glue is usually applied by hand, using a tube of glue, having a glue dispensing nozzle. Unfortunately, it is very difficult, even for an experienced worker, to keep the glue in a continuous bead. Not only does the bead tend to waver, but the application pressure upon the workpiece also varies, affecting the quality of the bead.

Certain construction tasks can suffer from an inconsistent bead. An inconsistent bead can mean inconsistent structural strength of the bond between the workpiece and another object. In addition, in certain crafts, especially those involving glass, a wavering bead can be visible in the finished product.

The prior art shows different devices which are used to aid in glue application. While these units may be suitable for the particular purpose employed, or for general use, they would not be as suitable for the purposes of the present invention as disclosed hereafter.

SUMMARY OF THE INVENTION

It is an object of the invention to produce a glue guide which is capable of accepting a glue dispensing nozzle from a glue container, and is capable of guiding the glue dispensing nozzle along a workpiece to provide a consistent bead of glue.

It is another object of the invention to provide a glue guide which is capable of guiding the glue dispensing nozzle along the workpiece, wherein the bead created thereby remains parallel to a longitudinal edge of the workpiece. Accordingly, a straight edge is provided on the glue guide to engage the longitudinal edge, and hold the glue dispensing nozzle a fixed distance therefrom.

It is a further object of the invention to provide a glue guide which is intended for use on a workpiece having a relatively uniform width, and is capable of centering a bead on the workpiece. Thus, a pair of straight edges are provided which engage two parallel edges of the workpiece. A holster for accepting the glue dispensing nozzle is centered between the straight edges.

The invention is a glue guide, for creating a bead of glue upon a workpiece having a pair of substantially parallel longitudinal edges and a work surface between the longitudinal edges and perpendicular thereto. The glue guide comprises a cross member, and a pair of straight edges extending perpendicular to the cross member. A holster is situated on the cross member, centered between the straight edges. The holster is tubular, shaped to accept a glue dispensing nozzle from a glue container. Once the glue dispensing nozzle is inserted into the holster, the straight edges engage the longitudinal edges of the workpiece, and guide the glue dispensing nozzle along the work surface, substantially parallel to the longitudinal edges. Thus, the glue dispensing nozzle can create a straight, uniform bead of glue that extends along the work surface and is centered between the longitudinal edges.

To the accomplishment of the above and related objects the invention may be embodied in the form illustrated in the accompanying drawings. Attention is called to the fact, however, that the drawings are illustrative only. Variations are contemplated as being part of the invention, limited only by the scope of the claims.

BRIEF DESCRIPTION OF THE DRAWINGS

In the drawings, like elements are depicted by like reference numerals. The drawings are briefly described as follows.

DETAILED DESCRIPTION OF THE PREFERRED EMBODIMENTS

Figure 1:
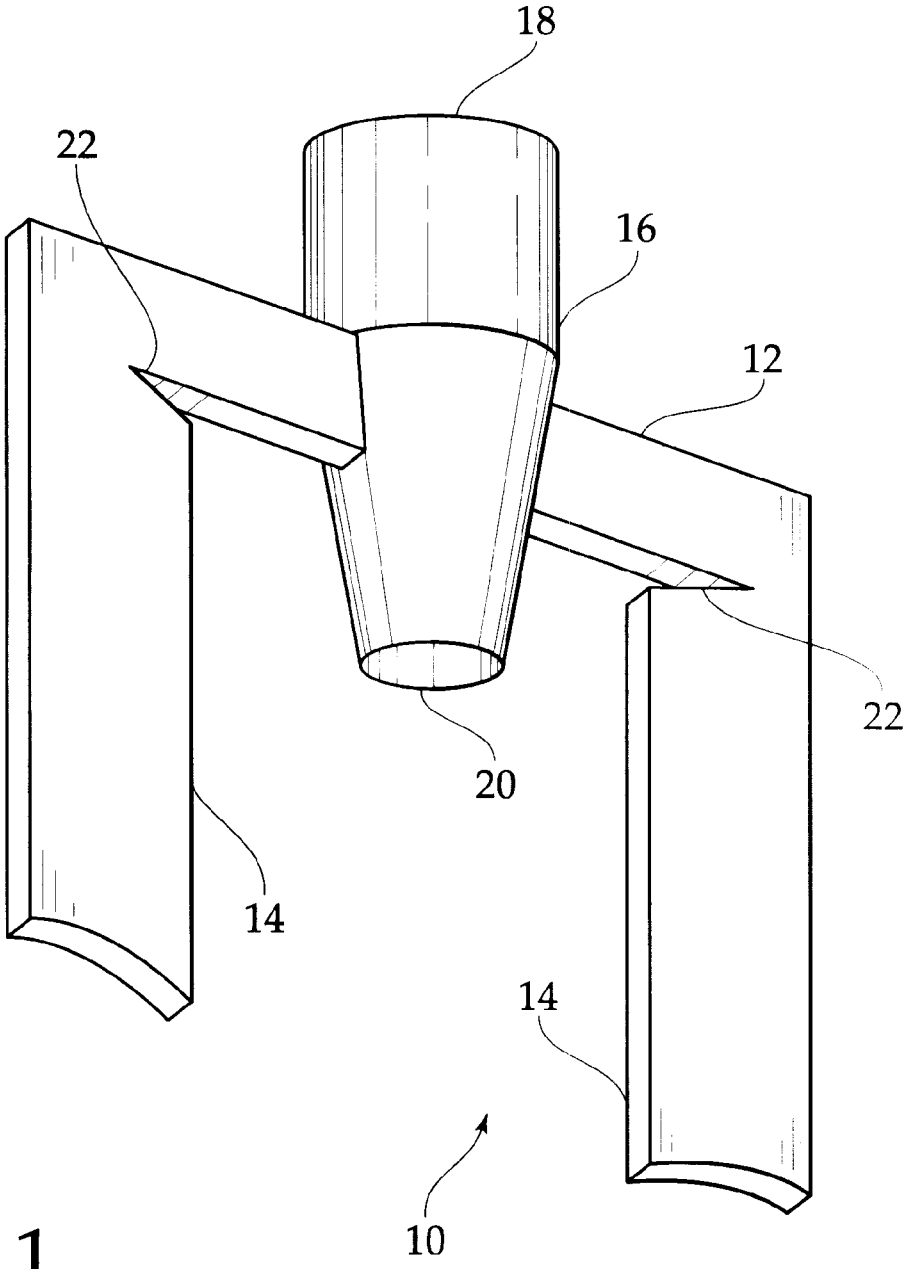
FIG. 1 is a diagrammatic perspective view, illustrating the glue guide, per se.

FIG. 1 illustrates a glue guide 10. The glue guide has a cross member 12, and a pair of straight edges 14 extending perpendicular to the cross member 12. A holster 16 located on the cross member 12 a fixed distance from each of the straight edges 14, and is preferably centered between the straight edges 14.

The holster 16 has a nozzle accepting end 18 and a dispensing end 20, which are both open. The nozzle accepting end 18 is larger in diameter than the dispensing end 20. The dispensing end 20 extends between the straight edges 14.

The straight edges 14 each have a notch 22 extending parallel to the cross member 12. Said notches 22 are located where the straight edges 14 meet the cross member 12. Said notches 22 allow the straight edges 14 to flex toward and away from each other to adjust for inaccuracies in its intended workpiece. The straight edges 14 may be different lengths, extending different distances from the cross member 12, to allow use in a variety of different work situations, including those where one edge of the workpiece is relatively shallow. In that case, the longer straight edge 14 would ensure that the holster 16 remains true to at least one edge of the workpiece.

Figure 2:
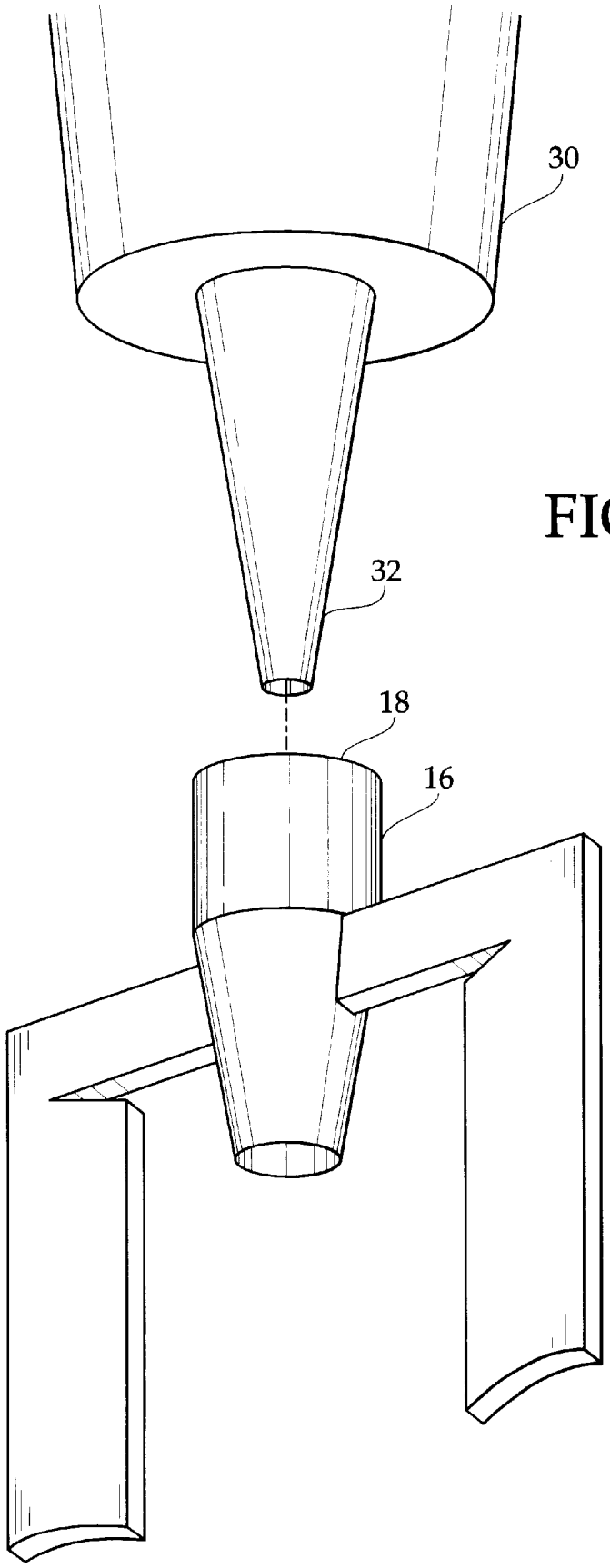
FIG. 2 is a diagrammatic perspective view, illustrating the glue dispensing nozzle being inserted into the holster, just prior to use.

FIG. 2 illustrates a glue container 30 having a glue dispensing nozzle 32. The glue dispensing nozzle 32 is being inserted into the nozzle accepting end 18 of the holster 16. The holster 16 forms a tube which has a taper that follows that of the glue dispensing nozzle 32 of the glue container 30.

Figure 3:
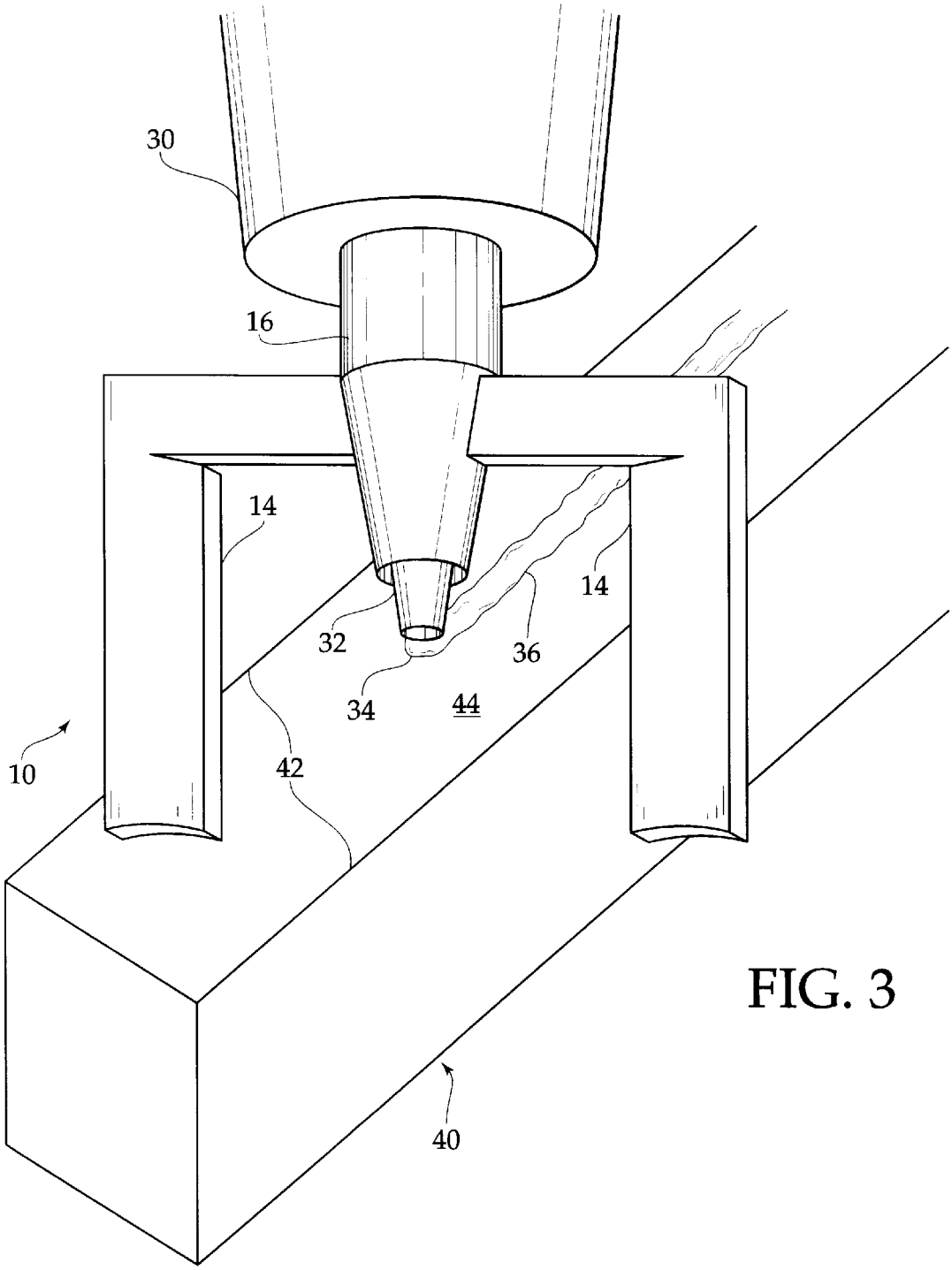
FIG. 3 is a diagrammatic perspective view, wherein a workpiece is illustrated, and wherein the glue guide is being used to apply a uniform longitudinal bead on the workpiece.

In FIG. 3, the glue dispensing nozzle 32 of the glue container 30 has been fully inserted through the holster 16. The glue guide 10 is operatively engaged with the workpiece 40. The workpiece 40 has two substantially parallel longitudinal edges 42 and a planar work surface 44 extending between the longitudinal edges 42 and perpendicular thereto. Each of the straight edges 14 engages one of the longitudinal edges 42. Glue 34 is applied to the work surface 44 as the glue guide 10 is guided along the longitudinal edges 42. The holster 16 maintains the glue dispensing nozzle 32 parallel to the longitudinal edges 42. Thus, a glue bead 36 is created along the work surface 44 which is substantially parallel to the longitudinal edges 42.

In conclusion, herein is presented a glue guide which is capable of accepting the glue dispensing nozzle from a glue container, and is capable of guiding the glue dispensing nozzle along a workpiece, creating a consistent bead of glue that is centered between the longitudinal edges of the workpiece.

What is claimed is:

1. A glue guide, used cooperatively with a glue container having a glue dispensing nozzle, and used upon a workpiece having at least one longitudinal edge and a work surface perpendicular thereto, comprising:

a cross member;

two straight edges, parallel to each other, attached to the cross member and extending perpendicular thereto;

a holster situated on the cross member centered between the straight edges, so that the glue guide may operatively engage workpiece having two parallel longitudinal edges and create a bead of glue upon the work surface that is centered between the longitudinal edges, said holster having a nozzle accepting end and a dispensing end, said dispensing end extending between the straight edges, the holster tapered between the nozzle accepting end and dispensing end, the nozzle accepting end allowing insertion of the glue dispensing nozzle;

at least one notch, said notch located where the cross member is attached to one of the straight edges, said notch extending parallel to the cross member, for allowing the straight edge to flex slightly away from the other straight edge to compensate for inaccuracies in the distance between the longitudinal edges of the workpiece; and wherein the glue dispensing nozzle may be guided along the work surface with the straight edge engaging the longitudinal edge of the workpiece so that the glue dispensing nozzle may create a uniform bead of glue that is parallel to the longitudinal edge.

2. The glue guide as recited in claim 1, wherein the straight edges have different lengths whereby they each extend from the cross member a different distance.

3. The glue guide as recited in claim 1, wherein the glue guide has two notches, one is located on each of the straight edges.

* * * * *